United States Patent [19]

Tattermusch

[11] Patent Number: 5,014,339

[45] Date of Patent: May 7, 1991

[54] DEVICE FOR HEATING UP A FLOW OF GAS

[75] Inventor: Peter Tattermusch, Altdorf, Fed. Rep. of Germany

[73] Assignee: Deutsche Forschungsanstalt fur Luft- und Raumfahrt e.V., Bonn, Fed. Rep. of Germany

[21] Appl. No.: 287,451

[22] Filed: Dec. 20, 1988

[30] Foreign Application Priority Data

Dec. 30, 1987 [DE] Fed. Rep. of Germany ..... 3744498

[51] Int. Cl.[5] ..... H05B 1/00; F24H 3/02

[52] U.S. Cl. ..... 392/491; 219/530; 219/540; 392/356; 392/379; 392/416; 392/483; 432/31

[58] Field of Search ..... 219/359–382, 219/354, 343, 381, 382, 338, 540, 530; 126/90 A; 432/31; 392/355, 356, 379, 416, 483

[56] References Cited

U.S. PATENT DOCUMENTS

| | | | |
|---|---|---|---|
| 1,652,438 | 12/1927 | Hicks | 219/367 X |
| 1,705,812 | 3/1929 | Fisher | 126/90 A |
| 1,713,013 | 5/1929 | Wandless | 219/377 |
| 1,923,083 | 8/1933 | Fisher | 219/367 X |
| 1,926,473 | 9/1933 | Wood | 219/365 |
| 2,379,705 | 7/1945 | Graves | 219/370 |
| 2,476,492 | 7/1949 | Hersh | 219/366 X |
| 2,476,913 | 11/1949 | Berve et al. | 219/365 |
| 2,683,796 | 7/1954 | Koff | 219/365 X |
| 2,863,978 | 12/1958 | Young | 219/366 |
| 2,919,338 | 12/1959 | Covault et al. | 219/367 X |
| 2,938,101 | 5/1960 | Borzmer | 219/365 X |
| 3,077,531 | 2/1963 | Wompey | 219/377 |
| 3,180,972 | 4/1965 | Covault | 219/365 |
| 3,471,681 | 10/1969 | Miller | 219/368 |
| 3,506,249 | 4/1970 | Cooper | 432/31 X |
| 3,519,064 | 7/1970 | Cooper | 432/31 X |
| 3,519,255 | 7/1970 | Cooper | 432/31 X |
| 3,550,919 | 12/1970 | Cooper | 432/31 X |
| 3,575,582 | 4/1971 | Covault | 219/368 |
| 3,623,712 | 11/1971 | McNeilly et al. | 219/354 X |
| 3,807,366 | 4/1974 | Murtland | 219/301 X |
| 3,862,397 | 1/1975 | Anderson et al. | 219/343 X |
| 3,906,188 | 9/1975 | Gamell | 219/354 X |
| 4,042,334 | 8/1977 | Matovich | 219/354 X |
| 4,055,165 | 10/1977 | Scragg et al. | 219/338 X |
| 4,197,447 | 4/1980 | Jones | 219/377 X |
| 4,309,594 | 1/1982 | Jones | 219/377 X |
| 4,310,747 | 1/1982 | Rice et al. | 219/381 |
| 4,446,817 | 5/1984 | Crawley | 219/343 X |
| 4,680,448 | 7/1987 | Fester | 219/377 X |

FOREIGN PATENT DOCUMENTS

| | | | |
|---|---|---|---|
| 802131 | 11/1931 | Australia | 219/377 |
| 473553 | 5/1951 | Canada | 219/377 |
| 0124769 | 8/1988 | European Pat. Off. . | |
| 1186156 | 1/1965 | Fed. Rep. of Germany . | |
| 2363006 | 7/1974 | Fed. Rep. of Germany | 219/365 |
| 1311081 | 10/1962 | France | 219/377 |
| 1502839 | 10/1967 | France | 219/366 |
| 2442409 | 11/1978 | France . | |
| 504722 | 4/1939 | United Kingdom | 219/377 |

OTHER PUBLICATIONS

M. Becker, "Solar Thermal Central Receiver Systems", *Proceedings of the Third International Workshop,* Jun. 23–27, 1986, Konstanz, FRG, vol. 2.

P. Tattermusch, "Volumetric Ceramic Receiver", Hanover Trade Fair, Apr. 1987.

*Primary Examiner*—Anthony Bartis

*Attorney, Agent, or Firm*—Kramer, Brufsky & Cifelli

[57] ABSTRACT

A device for heating a flow of substantially pure gas flowing in a flow direction to temperatures above about 600° C. is disclosed. The device includes a heat exchanger having a heat exchanger surface extending transversely to the flow direction whereby the substantially pure gas flows across the heat exchanger surface. The heat exchanger is made of a ceramic material for heating the pure gas without contaminating the gas flow. An infrared radiation source arranged outside of the flow of pure gas irradiates the heat exchanger surface.

26 Claims, 3 Drawing Sheets

Figure 3:
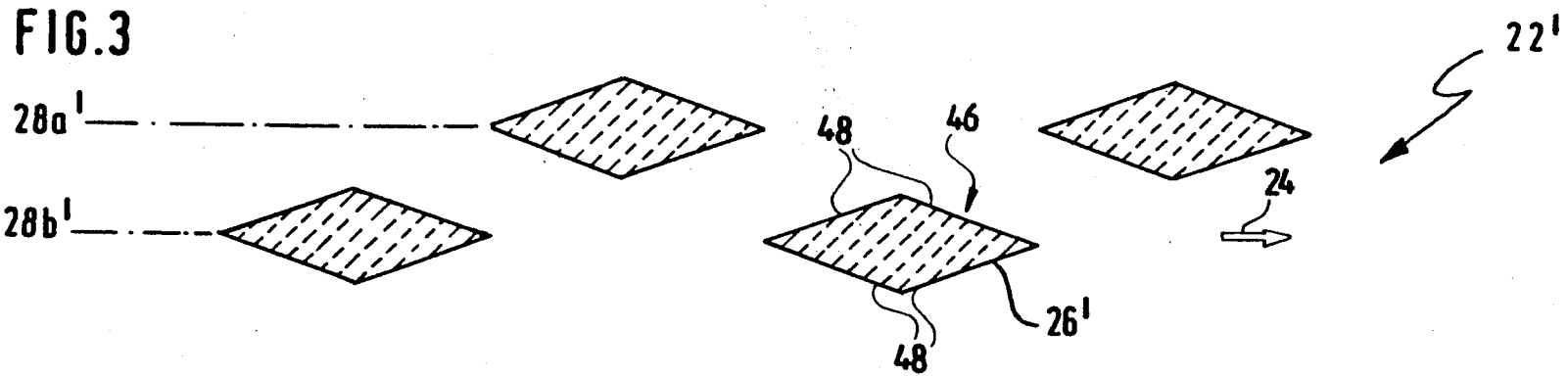

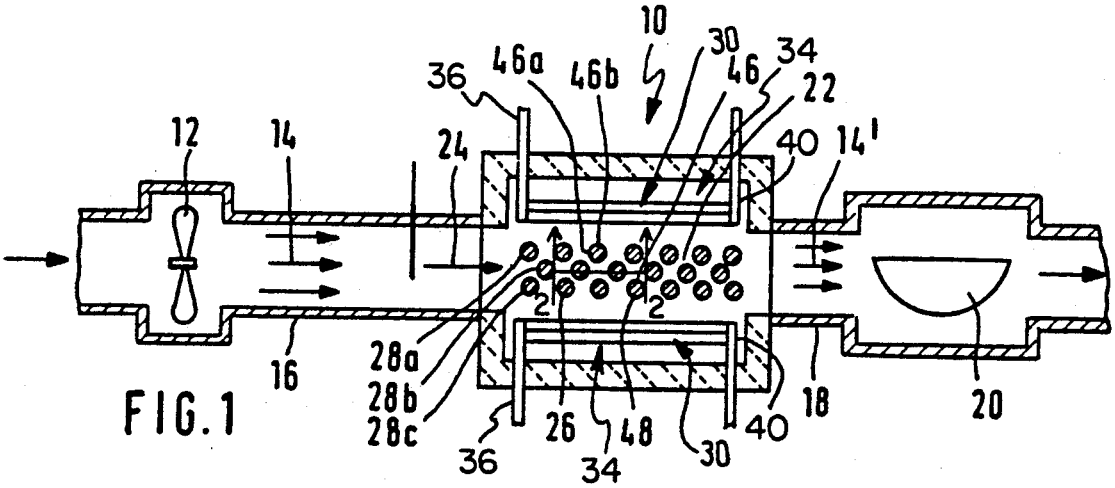
FIG. 1
FIG. 2
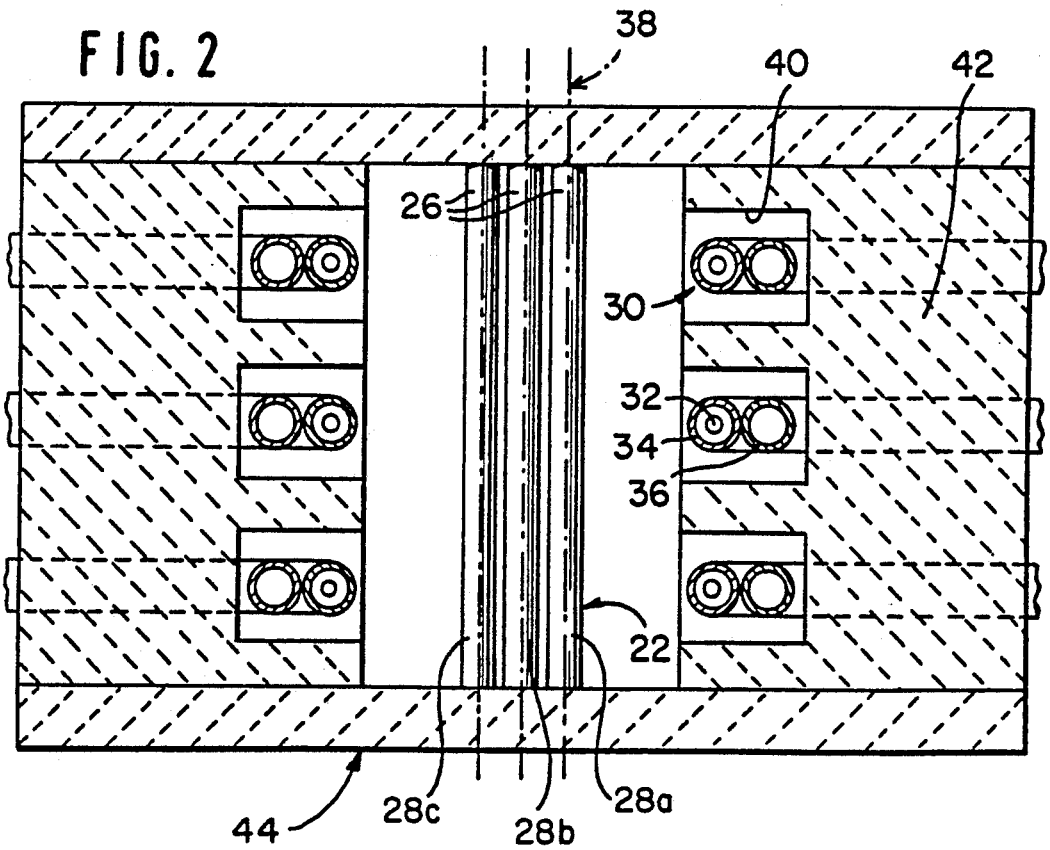

DEVICE FOR HEATING UP A FLOW OF GAS

The invention relates to a device for heating up a flow of gas, in particular, a flow of pure gas, to high temperatures, comprising a heat exchanger having heat exchanger surfaces which extend transversely to the flow of gas and against which the flow of gas flows.

In such known devices for heating up a flow of gas, the flow of gas usually flows through an electrically heated coil consisting, for example, of tungsten filament and is heated up by the heat exchange between surfaces of the coil against which the flow of gas flows.

With these devices, when the flow of gas is to be heated up to high temperatures, in particular, above 600 degrees C., there is the problem that the coil reacts chemically at its surface with the flow of gas and a corrosion-like layer preventing the heat exchange forms on the coil. When the required flow of gas heated up to high temperature is to be as pure as possible, there is also the problem that volatilization of material occurs on the coil as a result of the high coil temperatures required for heating up the flow of pure gas above 600 degrees C. and, therefore, the flow of pure gas always contains impurities caused by the volatilization of material.

Consequently, the devices known so far are unsuitable for heating up a flow of gas, in particular, a flow of pure gas, to high temperatures.

The object underlying the invention is, therefore, to so improve a device of the generic kind that simple and unproblematic heating-up of a flow of gas to high temperatures, in particular, above 600 degrees C., is achievable.

Third object is accomplished, in accordance with the invention, with a device of the kind described at the beginning by the heat exchanger surfaces being made of infrared-absorbent material and being irradiated by an infrared light source arranged outside of the flow of pure gas.

Accordingly, the gist of the present invention is to be seen in fact that herein the heat exchanger itself is only heated up by means of infrared radiation and so the heat exchanger surfaces may, in turn, be so selected that the material used for them neither reacts chemically with the flow of gas nor releases vapors which would contaminate the flow of gas. The infrared light source with which such problems might occur is arranged outside of the flow of gas so that the infrared light source cannot have a negative effect.

It is particularly advantageous for the infrared light source to be separated from the flow of gas by an infrared-transparent screen so that the infrared light source can, in turn, be arranged and operated in an environment which is completely separate from the flow of gas. This screen may be both material window and an aerodynamic window.

In order to prevent heating of the infrared-transparent screen, it is expedient for it to be cooled by the flow of gas.

All light sources which generate infrared light are conceivable as suitable infrared light source for the inventive device. It is, for example, also conceivable to use the sun as infrared light source and to allow the solar radiation to inpinge upon the heat exchanger surfaces through the infrared-transparent screen. Hence the inventive device for heating up flow of gas would be a particularly well suited possibility of using solar energy to produce high temperature.

However, terrestrial infrared light sources are normally used and these are advantageously enclosed so as to enable them to be operated under optimal conditions. Accordingly, within the scope of the inventive solution, the infrared-transparent screen in a preferred embodiment is part of an enclosure for the infrared light source.

As it is generally known, current-heated incandescent elements are often used as infrared light sources but, as explained at the beginning, these exhibit the known disadvantages when arranged directly in the flow of gas. These disadvantages are, however, avoidable if the infrared light source comprises a thermal emitter arranged in a vacuum in the enclosure. In this case, the thermal emitter can be operated at substantially higher temperatures than in the cases where it is arranged directly in the flow of gas as chemical reactions and manisfestations of corrosion on a surface thereof are avoided by the vacuum. Also, volatilization of material on the surface does not have a negative effect on the flow of gas. The known tungsten filaments are, therefore, preferably used as thermal emitters. It is, however, also conceivable to use electrically heated carbon rods as thermal emitters. When arranged in a vacuum, these can similarly be unproblematically heated up to high temperatures without their function being impaired.

Optimal heating-up of the heat exchanger is achievable by provision of several infrared light sources which are screened off in relation to one another. Within the scope of the invention, the screening-off of the infrared light sources in relation to one another offers the advantage that the infrared light sources do no heat one another up reciprocally but merely the heat exchanger.

In the embodiments described so far, nothing has been said about the design and arrangement of the heat exchanger surfaces themselves. Within the scope of the invention, it has proven advantageous for the heat exchanger surfaces to be oriented substantially at an incline to the flow of gas in order to achieve particularly effective heat transferral when the gas comes into contact with the heat exchanger surfaces.

Furthermore, an arrangement has proven expedient in which the heat exchanger surfaces are irradiated by the infrared light source at an incline to the flow of gas so that no difficulties occur with the advantageous straight-line conductance of the flow of gas through the heat exchanger.

A design which is particularly simple from a structural point of view and expedient within the scope of the invention is obtainable by the heat exchanger comprising several elements which are arranged one behind the other in the direction of flow and carry the heat exchanger surfaces. These elements are advantageously arranged in spaced relation to one another and expediently extend in their longitudinal direction transversely to the flow of gas. The design of the inventive device is particularly simple from a structural point of view if the elements are irradiated transversely to the direction of flow of the flow of gas as the infrared light sources can then be arranged on either side of the flow of gas.

The heat exchanger can be used as uniformly as possible by the elements being irradiated symmetrically to the direction of flow.

In order to make optimal use of the infrared radiation supplied by the infrared light source and, for example, where several infrared light sources are arranged opposite one another, to prevent these from heating one another up, provision is made for the elements to form an optically dense surface with their heat exchanger surfaces with respect to each direction of incidence of the infrared radiation, i.e., the heat exchanger is designed so as to prevent passage of the respective incident infrared radiation therethrough.

An embodiment has proven particularly expedient in which the heat exchanger surfaces of the individual elements are arranged in at least two rows extending in the direction of flow of the flow of gas and are spaced from one another in the direction of flow, in which the rows are spaced from one another transversely to the direction of flow, and in which the heat exchanger surfaces of one row cover the gaps of the respective other row for the incident infrared radiation.

It has, furthermore, proven expedient for the elements to be arranged such that the heat exchanger surface of an upstream element diverts the flow of gas impinging thereon at least partly to the heat exchanger surface of a downstream element.

As an alternative to the individual elements arranged one behind the other, provision is made in another preferred embodiment for the elements to be wall elements extending in the direction of flow.

In this case, it may, in addition, be expedient for the elements to form gas channels extending in the direction of flow.

Regarding the selection of the material for the elements, those which are made of a temperature-resistant material which is unable to react with the gas have proven their worth. In particular, the materials graphite, ceramics, glass, stone, clay ar also metal are possible. In this case, the metal may be selected so as not to react with the flow of gas since the choice of metal is not limited to such materials as are suitable as resistive element to the electrical heating-up but can be made in accordance with the above-mentioned criteria.

Further features and advantages of the invention are the subject of the following description and the appended drawings of several embodiments. The drawings show:

FIG. 1, a section through a first embodiment of an inventive device used in a system for heating up an object;

FIG. 2 a section taken transversely to the direction of flow through the first embodiment in FIG. 1;

FIG. 3 an illustration similar to FIG. 1 of a second embodiment; and

Figure 4:
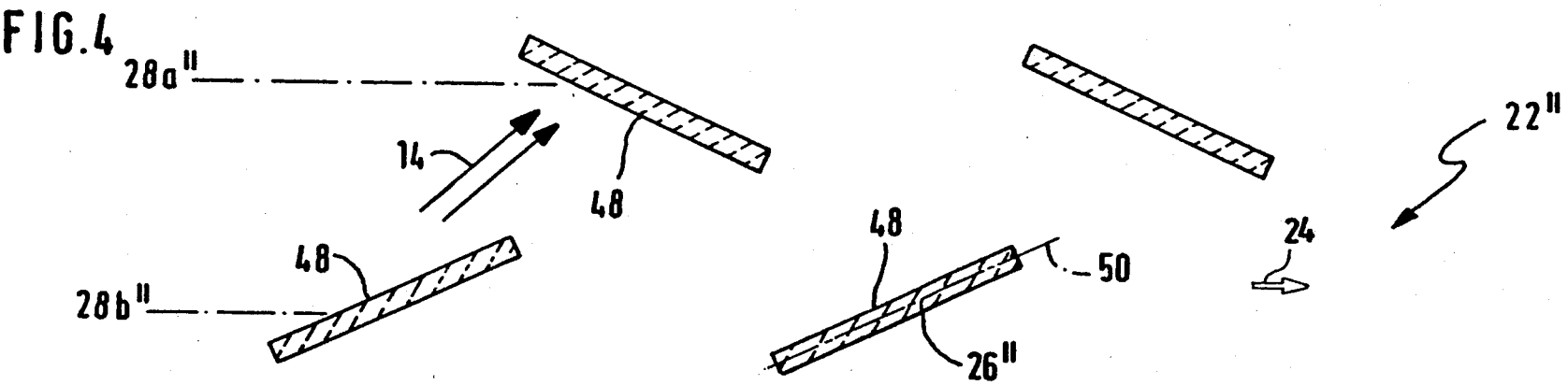
Figure 5:
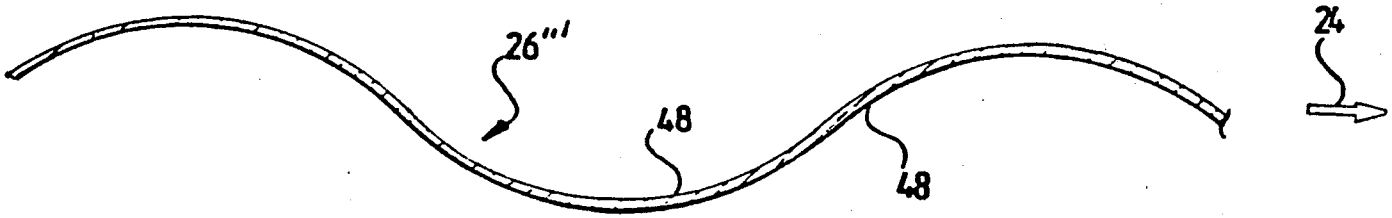

FIG. 4 an illustration similar to FIG. 3 of a third embodiment;

FIG. 5 an illustration similar to FIG. 3 of a fourth embodiment; and

Figure 6:
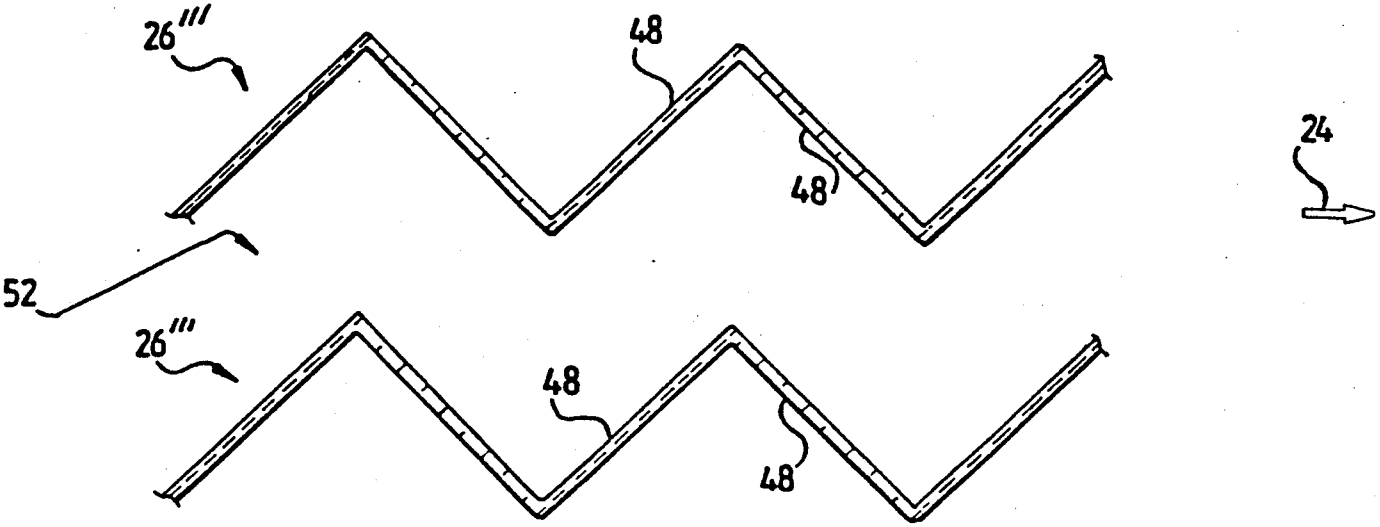

FIG. 6 an illustration similar to FIG. 3 of a fifth embodiment.

FIG. 1 shows an inventive device designated in its entirety 10 for heating up a flow of pure gas for use in a complete system in which a flow of pure gas 14 is generated by a fan 12 and conducted through a passage 16 to the inventive device 10 and after flowing through the inventive device 10, the heated-up flow of pure gas 14' is conducted through a further channel 18 in order to flow around an object 20 which is to be heated up.

As shown in FIGS. 1 and 2, the inventive device 10 comprises a heat exchanger 22 arranged in the flow of pure gas 14 and containing elements 26 disposed one behind the other in staggered relation to one another in the direction of flow 24 of the flow of pure gas 14. In the case of the first embodiment, the elements 26 are cylindrical bars. These elements 26 are arranged, for example, in three parallel rows 28*a, b, c* in the direction of flow 24. The elements 26 or rows 28*a* and 28*c* are at the same level in the direction of flow 24 and their spacing from one another corresponds at most to the extent of the elements 26 in the direction of flow 24. On the other hand, the elements 26 of row 28*b* are arranged in gaps between the elements 26 of rows 28*a* and *c* so that they cover spaces between the elements 26 or rows 28*a* and 28*c*, viewed transversely to the direction of flow 24, and, therefore, the heat exchanger 22 forms an optically dense surface, viewed transversely to the direction of flow 24.

Infrared emitters 30 are arranged on either side of the heat exchanger 22 and extend parallel to the direction of flow 24. As infrared light source 32, the infrared emitters 30 comprise a tungsten filament arranged in a vacuum in a screening tube 34. This screening tube 34 is made of infrared-transparent material, more particularly, of quartz glass, and is expediently provided on its side facing away from the heat exchanger 22 with an infrared-reflecting mirror coating, for example, a layer of gold.

In order to achieve effective cooling of these infrared emitters, a cooling pipe 36 with water flowing through it is formed on the side of the screening tube 34 facing away from the heat exchanger 22.

In the embodiment shown in FIG. 2, infrared emitters 30 are arranged one above the other in the direction of longitudinal axes 38 of the elements 26 and parallel to the direction of flow. Each infrared emitter 30 is accommodated in a groove 40 of a side wall element 42 of a housing designated in its entirety 44 and each of the grooves 40 extends parallel to the direction of flow 24 and preferably also has pure gas flowing therethrough.

The individual elements 26 of the heat exchanger 22 are irradiated substantially throughout their entire extent in the direction of their longitudinal axis 38 by the total of three infrared emitters 30 arranged on each side of the heat exchanger 22. It is mainly a region of a circumferential surface 46 which is directly subjected to the infrared radiation that serves as heat exchanger surface 48. It is, in fact, possible to also use the regions of the circumferential surface 46 which are not subjected to the infrared radiation as heat exchanger surface, in which case, these are similarly heated up by means of heat conduction in the material of the elements 26. This may, however, only serve as additional possibility for heat exchange.

In the inventive heat exchanger 22, on account of the infrared emitters 30 arranged on either side of the heat exchanger 22 with respect to the direction of flow 24, the elements 26 of the two outer rows 28*a* and 28*c* are subjected to the infrared radiation on their respective halves of their circumferential surface 46 facing the infrared emitters 30 and, therefore, preferably serve with these as heat exchanger surfaces 48, whereas the elements 26 of the center row 28*b* are also subjected to the infrared radiation substantially over the full circumferential surface 46 by the infrared emitters 30 arranged on either side and so the full circumferential surface 46 also serves as heat exchanger surface 48.

Furthermore, owing to the staggered arrangement of the elements 26 in row 28*b* with respect to rows 28*a* and *c*, the heat exchanger 22 forms an optically dense surface on its sides facing the infrared emitters 30 and so the total radiation power of the infrared emitters is absorbed and, in particular, no infrared radiation from one infrared emitter 30 arranged on one side reaches the oppositely arranged infrared emitter 30 to unnecessarily heat it up in addition.

Also, arrangement of the infrared emitters 30 in the grooves 40 which respectively accommodate these ensures that the infrared emitters 30 do not irradiate each other reciprocally and cause additional unnecessary heating-up.

The inventive device for heating up a flow of pure gas operates in the following way: The flow of pure gas 14 flows towards the elements 26 of the heat exchanger 22 against their upstream circumferential surfaces 46*a* and along their lateral circumferential surfaces 46*b* serving as heat exchanger surfaces 48 and heating-up of the flow of pure gas 14 thus takes place as it passes through the entire heat exchanger 22. Furthermore, the flow of pure gas 14 flows at its edge areas through the individual grooves 40 and the infrared emitters 30 arranged therein and hence causes additional cooling of the screening tubes 34, which simultaneously results in heating-up of the edge areas of the flow of pure gas 14. The flow of pure gas 14' which has been heated up then leaves the heat exchanger 22 and flows through passage 18 to the object 20 which is to be heated up.

In the second embodiment of the inventive heat exchanger 22', illustrated in FIG. 3, the individual elements 26' are arranged one behind the other in two rows 28*a'* and 28*b'* in the direction of flow 24 but in staggered relation to one another transversely to the direction of flow 24 so as to fill the gaps and they have an elongate, for example, rhombic cross-section with respect to the direction of flow 24. The cross-section may, however, also have the shape of a stretched-out ellipsoid or a similar shape. As a result of this, the elements 26' face one of the infrared emitters 30 substantially with each region of their circumferential surface 46 and, in addition, the flow of pure gas 14 flows around almost the entire region of their circumferential surface 46 and, therefore, substantially the total circumferential surface 46 is avaliable as heat exchanger surface 48.

In a third embodiment of the inventive heat exchanger 22'', illustrated in FIG. 4, the elements 26'' are of lamella-type design and stand with their transverse axis 50 at an incline to the direction of flow 24. These elements 26'' are preferably arranged in the individual rows 28*a''* and 28*b''* in such a way that the respective upstream element 26'' of the one row 28*b''* or 28*a''* preferably diverts the flow of pure gas 14 to the element 26'' of the respective other row 28*a''* or 28*b''* and hence enables the heat exchanger surfaces 48 towards which the pure gas flows and which also face the infrared emitters 30 to be heated up as effectively as possible.

A fourth embodiment, illustrated in FIG. 5, differs from the previous embodiments in that the elements are not arranged individually one behind the other but are continuous wall elements 26''' extending in the direction of flow with an optional surface which promotes heat transferral to the flow of gas 14. In FIG. 5, these wall elements 26''' are of undulating configuration.

In the fifth embodiment, illustrated in FIG. 6, the wall elements 26''' extending in the direction of flow 24 form by their arrangement in spaced relation to each other transversely to the direction of flow 24 a gas channel 52 in which heating-up of the flow of gas 14 likewise occurs but, in this case, the wall elements 26''' are heated up by the infrared radiation and heating-up of the heat exchanger surfaces 48 facing the gas channel 52 occurs through heat conductance in the wall elements from the irradiated heat exchanger surfaces 48 facing away from the gas channel 52 to the heat exchanger surfaces 48 facing the gas channel 52.

In the embodiments described, pure gas temperatures of at least 900 degrees C. are attainable if ceramic material is used for elements 26.

The present disclosure relates to the subject matter disclosed in German application No. P 37 44 498.0 of Dec. 30, 1987, the entire specification of which is incorporated herein by reference.

What is claimed is:

1. Device for heating up a flow of substantially pure gas flowing in a flow direction to temperatures above about 600° C., comprising:

chamber means having walls defining a closed housing have an inlet and an outlet;

means establishing a flow of gas in a given direction through the housing from the inlet to the outlet thereof;

a heat exchanger in said housing having a heat exchanger surface extending transversely to said flow direction into the path of the gas flow whereby said substantially pure gas flows across said heat exchanger surface, said heat exchanger surface being made of infrared-absorbing ceramic material capable of heating the pure gas without contaminating the gas flow; and at least one infrared radiation source in said housing arranged parallel to the gas flow direction but outside a direct flow path to the heat exchanger of pure gas, said at least one radiation source being positioned in a groove in a wall of said housing and arranged to irradiate said heat exchanger surface to a temperature above about 600° C.

2. Device as defined in claim 1, characterized in that: said heat exchanger surfaces are oriented substantially at an incline to the direction of said flow of gas.

3. Device as defined in claim 1, characterized in that: said heat exchanger comprises several elements which are arranged one behind the other in the direction of flow of said flow of gas and define said heat exchanger surface.

4. Device as defined in claim 3, characterized in that: said elements are arranged in spaced relation to one another.

5. Device as defined in claim 3, characterized in that: said elements extend transversely to the direction of said flow of gas.

6. Device as defined in claim 3, characterized in that: said elements are irradiated transversely to said direction of flow of said flow of gas.

7. Device as defined in claim 6, characterized in that: said elements are irradiated symmetrically to said direction of flow.

8. Device as defined in claim 1, characterized in that: said heat exchange surface being made of material which is temperature-resistant and is unable to react with said flow of gas.

9. Device for heating up a flow of substantially pure gas flowing in a flow direction to temperatures above about 600° C., comprising:

chamber means having walls defining a closed housing have an inlet and an outlet;

means establishing a flow of gas in a given direction through the housing from the inlet to the outlet thereof;

a heat exchanger in said housing having a heat exchanger surface extending transversely to said flow direction in the path of the gas flow whereby said substantially pure gas flows across said heat exchanger surface, said heat exchanger surface being made of infrared-absorbing ceramic material capable of heating the pure gas without contaminating the gas flow; and a plurality of infrared radiation sources in said housing arranged parallel to said flow direction, but outside of the direct flow path of pure gas in spaced and each being disposed in a separate groove in a wall of said housing and arranged to irradiate said heat exchanger surface to a temperature above about 600° C.

10. Device as defined in claim 9, characterized in that: several of said infrared radiation sources are provided which are screened off in relation to one another.

11. Device as defined in claim 9, characterized in that: said heat exchanger surface being irradiated by said infrared radiation sources at an incline to said flow of gas.

12. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending transversely to said flow direction in the path of the gas flow whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing parallel to the gas flow direction but outside a direct flow path to the heat exchanger and arranged to irradiate said heat exchanger surface to a temperature above about 600° C.;

said infrared radiation sources being arranged with respect to no other and with respect to said heat exchanger in such a manner that each infrared radiation source cannot directly irradiate any of the other infrared radiation sources.

13. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending transversely to said flow direction in the path of the gas flow whereby said substantially pure gas flows across said heat exchanger surface, said heat exchanger surface being made of infrared-absorbing ceramic material capable of heating the pure gas without contaminating the gas flow; and an infrared radiation source arranged in said housing alongside said flow of pure gas parallel to the gas flow direction in heat exchange relation therewith and arranged to irradiate said heat exchanger surface to a temperature above about 600° C.;

said infrared radiation source comprising a thermal emitter arranged in a vacuum in an infrared transparent screen, said infrared transparent screen separating said thermal emitter from said flow of substantially pure gas and being cooled by said flow of substantially pure gas.

14. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending transversely to said flow direction in the path of the gas flow whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing alongside said flow of pure gas parallel to the gas flow direction in heat exchange relation therewith and arranged to irradiate said heat exchanger surface to a temperature above about 600° C.;

said infrared radiation sources being arranged with respect to each other and with respect to said heat exchanger in such a manner that no infrared radiation source cannot directly irradiate any of the other infrared radiation sources;

said infrared radiation sources comprising a thermal emitter arranged in a vacuum in an infrared transparent screen, said infrared transparent screen separating said thermal emitter from said flow of substantially pure gas and being cooled by said flow of substantially pure gas.

15. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending transversely to said flow direction in the path of the gas flow whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing parallel to the gas flow direction but outside a direct flow path to the heat exchanger and arranged to irradiate said heat exchanger surface to a temperature above about 600° C.;

said infrared sources arranged on one side of said heat exchanger being separated by screening means of said housing, said screening means being designed such that no infrared source on said one side can directly irradiate any other infrared sources on said one side.

16. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending transversely to said flow direction in the path of the gas flow whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing parallel to the gas flow direction but outside a direct flow path to the heat exchanger and arranged to irradiate said heat exchanger surface to a temperature above about 600° C.;

said infrared sources being arranged on opposite sides of said heat exchanger and said infrared sources on each side of said heat exchanger being separated by screening means, said screening means being designed such that no infrared source on one of said sides can directly irradiate any other infrared sources on the same side, and said heat exchanger being designed and arranged such that it prevents each infrared source on one of said sides from directly irradiating the infrared sources on said other side.

17. Device as defined in claim 16, characterized in that:

said heat exchanger comprises several elements which form an optically dense surface with their heat exchanger surfaces with respect to each direction of incidence of the infrared radiation.

18. Device as defined in claim 17, characterized in that:

said heat exchanger surfaces of said individual elements are arranged in at least two rows extending in said direction of flow of said flow of gas and are spaced from one another in said direction of flow, in that:

said rows are spaced from one another transversely to said direction of flow, and in that:

said heat exchanger surfaces of one row cover the gaps of said respective other row for the incident infrared radiation.

19. Device as defined in claim 18, characterized in that:

said elements are arranged such that a heat exchanger surface of an upstream element diverts the flow of gas impinging on it at least partly to a heat exchanger surface of a downstream element.

20. Device as defined in claim 17, characterized in that:

said elements are imperforate wall elements extending in said direction of flow.

21. Device as defined in claim 17, characterized in that:

said elements form gas channels extending in said direction of flow.

22. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending in said flow of substantially pure gas whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing parallel to the gas flow direction but outside a direct flow path to the heat exchanger and arranged to irradiate said heat exchanger surface to a temperature above about 600° C.;

said infrared radiation sources being arranged with respect to each other and with respect to said heat exchanger in such a manner that no infrared radiation source can directly irradiate any of the other infrared radiation sources.

23. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending in said flow of substantially pure gas whereby said substantially pure gas flows across said heat exchanger surface, said heat exchanger surface being made of infrared-absorbing ceramic material capable of heating the pure gas without contaminating the gas flow; and an infrared radiation source arranged in said housing alongside said flow of pure gas parallel to the gas flow direction in heat exchanger relation therewith and arranged to irradiate said heat exchanger surface to a temperature above about 600° C.;

said infrared radiation source comprising a thermal emitter arranged in a vacuum in an infrared transparent screen, said infrared transparent screen separating said thermal emitter from said flow of substantially pure gas and being cooled by said flow of substantially pure gas.

24. Device for heating up a flow of substantially pure gas flowing in a flow direction to temperature above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending in said flow of substantially pure gas whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing alongside said flow of pure gas parallel to the gas flow direction in heat exchange relation therewith and arranged to irradiate said heat exchanger surface to a temperature above about 600° C.;

said infrared radiation sources being arranged with respect to each other and with respect to said heat exchanger in such a manner that no infrared radiation source can directly irradiate any of the other infrared radiation sources, said infrared radiation sources comprising a thermal emitter arranged in a vacuum in an infrared transparent screen, said infrared transparent screen separating said thermal emitter from said flow of substantially pure gas and being cooled by said flow of substantially pure gas.

25. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending in said flow of substantially pure gas whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing parallel to the gas flow direction but outside a direct flow path to the heat exchanger in heat exchanger relation therewith and arranged to irradiate said heat exchanger surface to a temperature above about 600° C.;

said infrared sources arranged outside of said direct flow path of said gas being separated by screening means of said housing, said screening means being designed such that no infrared source outside of said direct flow path can directly irradiate any of other infrared sources.

26. Device for heating up a flow of substantially pure gas flowing in a flow direction to temperatures above about 600° C., comprising:

a housing having a gas inlet and a gas outlet;

means establishing a flow of gas in a given flow direction through said housing from the gas inlet to the gas outlet thereof;

a heat exchanger arranged in said housing and having a heat exchanger surface extending in said flow of substantially pure gas whereby said substantially pure gas flows across said heat exchanger surface, said heat exchanger surface being made of infrared-absorbing ceramic material capable of heating the pure gas without contaminating the gas flow; and a plurality of infrared radiation sources arranged in said housing parallel to the gas flow direction but outside a direct flow path to the heat exchanger in heat exchange relation therewith and arranged to irradiate said heat exchanger surface to a temperature above about 600° C.;

said infrared sources being arranged on opposite sides of said heat exchanger and said infrared sources on each side of said heat exchanger being separated by screening means, said screening means being designed such that no infrared source on one of said sides can directly irradiate any other infrared sources on the same side;

and said heat exchanger being designed and arranged such that it prevents each infrared source on one of said sides from directly irradiating any infrared source on said other side.

* * * * *